US005715544A

United States Patent [19]

Huffman et al.

[11] Patent Number: 5,715,544

[45] Date of Patent: Feb. 10, 1998

[54] TOILET WITH IMPROVED FLUSH NOZZLE

[75] Inventors: Carrie E. Huffman, Jackson; John E. Hammond, Redford; George Grech, Garden City; John M. Antos, Ann Arbor, all of Mich.

[73] Assignee: Thetford Corporation, Ann Arbor, Mich.

[21] Appl. No.: 562,035

[22] Filed: Nov. 22, 1995

[51] Int. Cl.[6] ..... E03D 11/13

[52] U.S. Cl. ..... 4/420

[58] Field of Search ..... 4/420, 420.5

[56] References Cited

U.S. PATENT DOCUMENTS

| | | | |
|---|---|---|---|
| 155,814 | 10/1874 | Stockton | 4/420 |
| 248,195 | 10/1881 | Moore | 4/420 |
| 382,089 | 5/1888 | Ivers | 4/420 |
| 1,107,515 | 8/1914 | Haas | 4/420 |
| 1,142,249 | 6/1915 | Griffiths | 4/420 |
| 3,411,162 | 11/1968 | Palmer | 4/420 |
| 4,404,696 | 9/1983 | Heinze et al. | 4/420 |

FOREIGN PATENT DOCUMENTS

| | | | |
|---|---|---|---|
| 0020815 | 7/1956 | Germany | 4/420 |
| 0583569 | 10/1958 | Italy | 4/420 |

*Primary Examiner*—Robert M. Fetsuga

*Attorney, Agent, or Firm*—Harness, Dickey & Pierce, P.L.C.

[57] ABSTRACT

A water flush toilet having an improved flush nozzle in which a portion of the flush water is discharged downward at a higher velocity from the nozzle over a rear section of a toilet bowl for scrubbing the rear section. The remainder of the water is discharged laterally outward at a lower velocity from the nozzle in opposite directions for flow in a spiral path over the bowl surface to rinse the bowl.

5 Claims, 5 Drawing Sheets

TOILET WITH IMPROVED FLUSH NOZZLE

BACKGROUND AND SUMMARY OF THE INVENTION

The present invention relates generally to a toilet and in particular to a toilet with an improved flush nozzle for cleaning waste from the surface of the toilet bowl.

In recreational vehicles and other locations where water is not readily and abundantly available, it is necessary to minimize the quantity of water required to flush the toilet. This necessitates that the maximum benefit be achieved with the limited amount of water which is used. One approach to maximizing the use of water in a flush toilet is to discharge the flush water so that it flows circumferentially around the bowl in a spiral pattern. The spiral flow path allows the water to wash over a larger area of the bowl surface than if the water was discharged downward into the bowl toward the bottom discharge outlet. However, the spiral flow of water does not always provide sufficient scrubbing of the bowl surface, particularly the rear section of the bowl.

Accordingly, it is an object of the present invention to provide an improved flush nozzle for a toilet which provides improved scrubbing of the bowl rear surface.

It is a further object of the present invention to provide an improved flush nozzle which provides for an efficient use of a limited quantity of water in flushing the toilet bowl.

The improved flush nozzle of the present invention directs a portion of the water in a circumferential direction to flow in a spiral path while the remainder of the water is discharged downward, across the rear surface of the bowl to provide improved scrubbing of the bowl rear surface.

The toilet of the present invention has a bowl with an open upper end and a bottom discharge outlet through which waste is flushed from the bowl. The bowl surface extends downwardly and inwardly from the open upper end to the bottom discharge outlet. The flush nozzle is placed in the rear of the bowl. The nozzle has an orifice for discharging the water into the bowl with a portion of the water being directed downwardly, over the rear section of the bowl. The remaining water is directed laterally in opposite directions to flow circumferentially around the bowl in a spiral path to the front of the bowl. This multiple direction water flow accomplishes a substantially total wetting of the bowl for cleaning purposes.

In a preferred embodiment, a ledge is formed in the bowl intermediate the upper and lower ends, dividing the bowl into an upper portion and a lower portion. The rear section of the bowl is not interrupted by the ledge. The ledge merges smoothly into the rear section of the bowl. The flush nozzle is placed in the rear section of the bowl, above the ledge. The laterally directed water is discharged onto the ledge where it gradually falls off and flows over the lower portion of the bowl in a spiral path.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
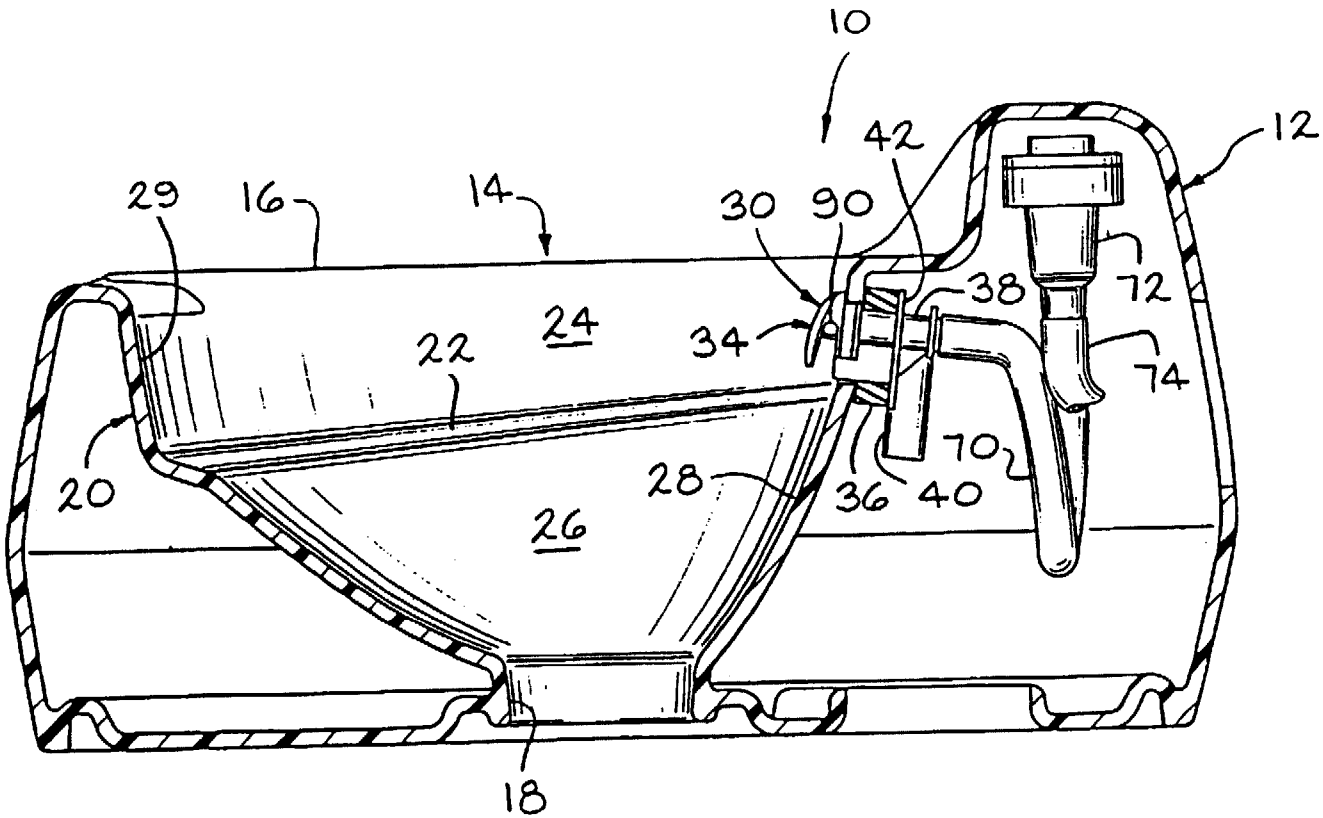
FIG. 1 is a vertical sectional view through the toilet bowl showing the ledge and the nozzle.
Figure 2:
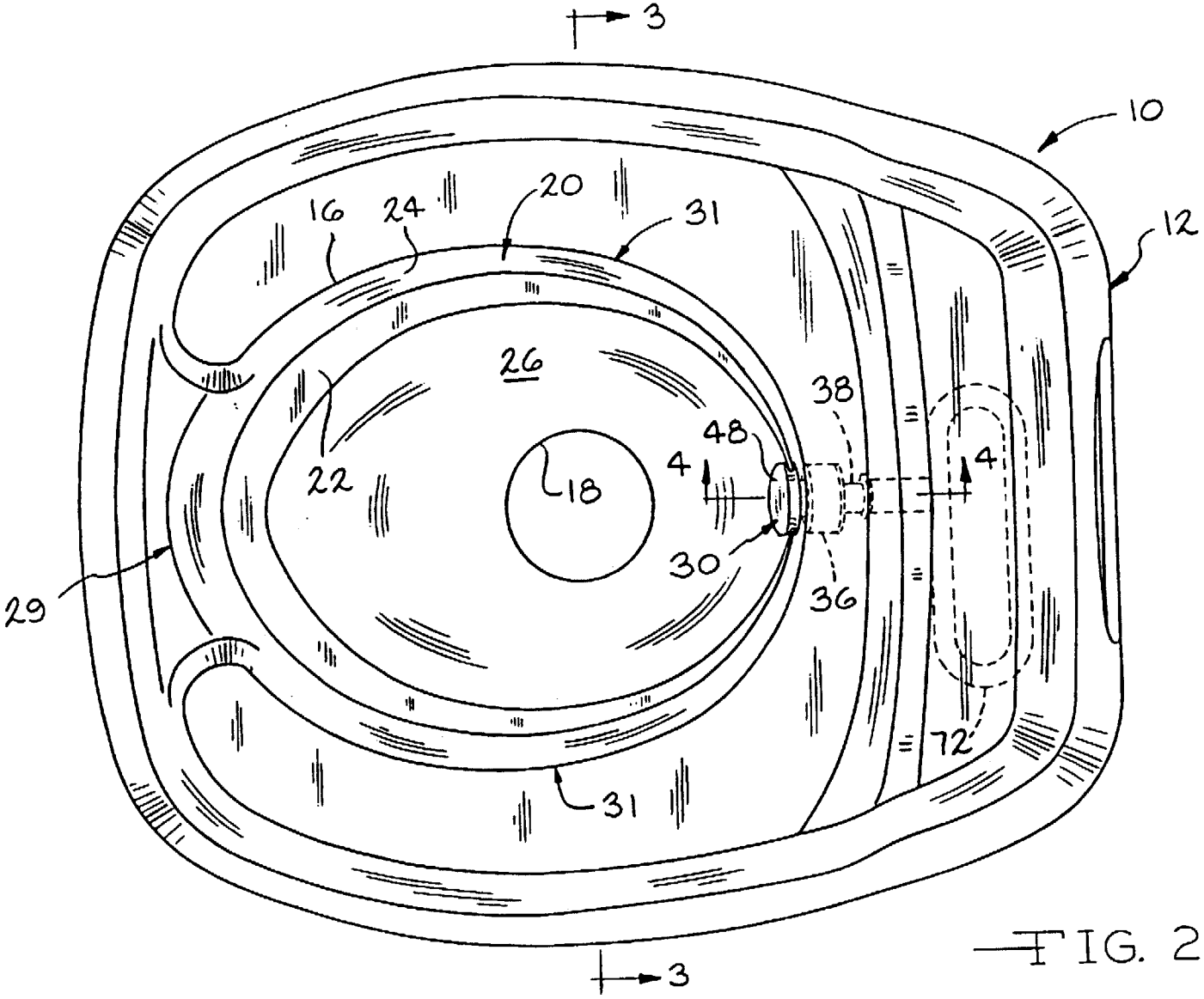
FIG. 2 is a top plan view of the toilet bowl.

The toilet of the present invention having an improved flush nozzle is shown in FIG. 1 and designated generally at 10. The toilet 10 includes a bowl portion 12 which forms a toilet bowl 14 having an open upper end 16, and a bottom discharge outlet 18. The bowl has a surface 20 that extends downwardly and inwardly from the open upper end 16 to the bottom discharge outlet 18.

In the preferred embodiment shown, the bowl surface 20 has a ledge 22 that extends generally circumferentially around the bowl, dividing the bowl into an upper portion 24 and a lower portion 26. The ledge does not extend completely around the bowl. The rear section of the bowl is not interrupted by the ledge. The ledge 22 merges smoothly into the wall of the bowl on each side of the bowl rear section 28. The bowl has a front section 29 opposite the rear section 28. Arcuate side sections 31 extend between the front and rear sections 28, 29. The nozzle described below can be used in a bowl that does not include a ledge.

Figure 4:
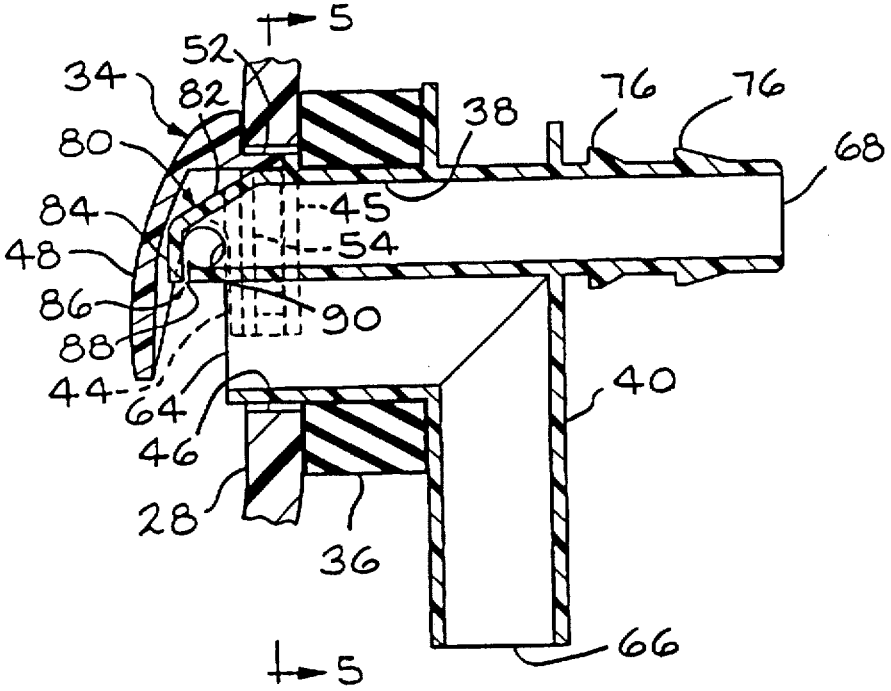
FIG. 4 is a vertical side section view of the nozzle as seen from substantially the line 4—4 of FIG. 2.
Figure 5:
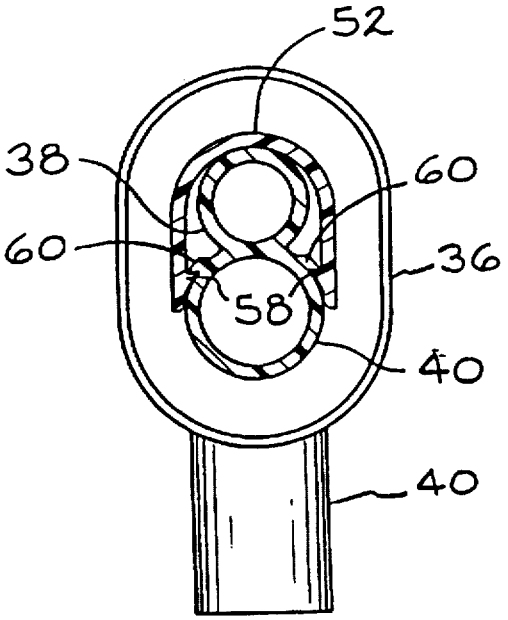
FIG. 5 is a vertical front section view of the nozzle as seen from substantially the line 5—5 of FIG. 4.
Figure 6:
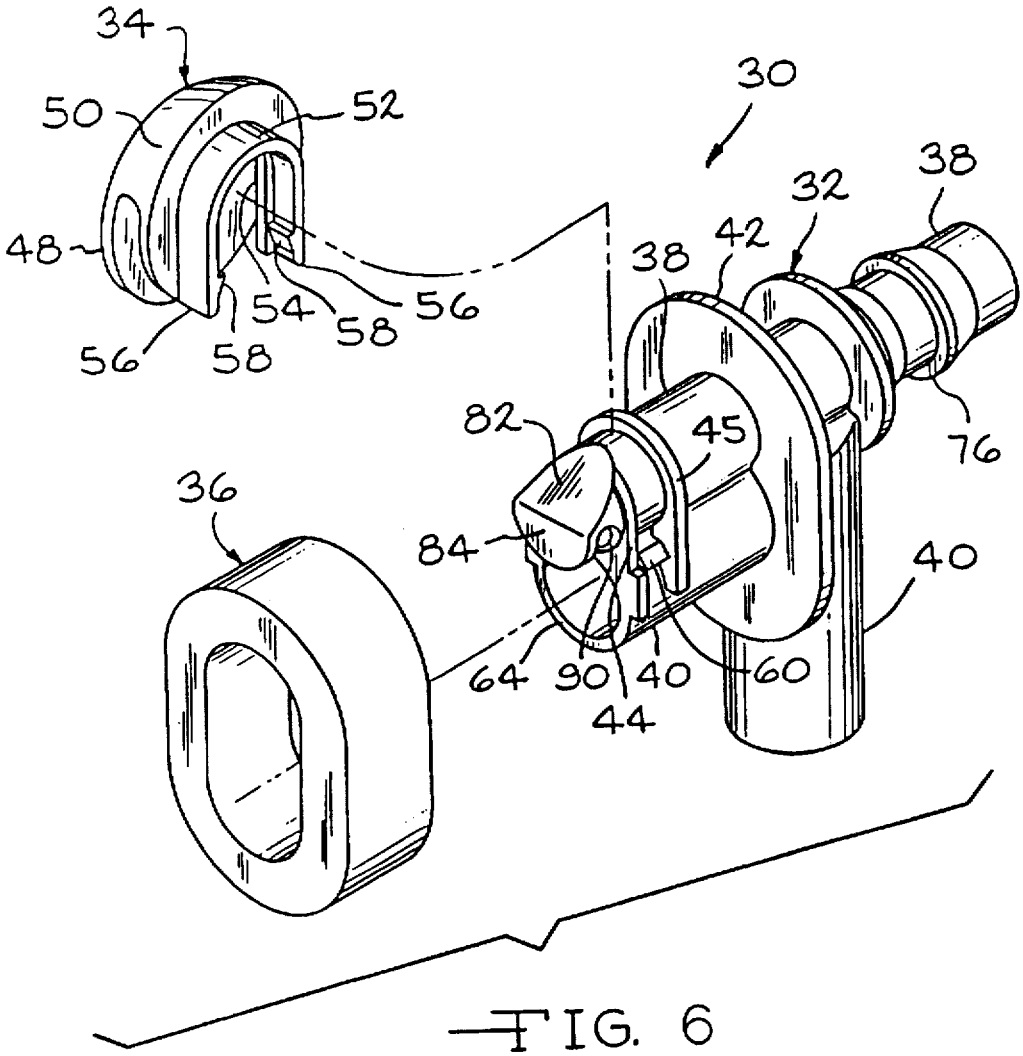
FIG. 6 is an exploded perspective view of the nozzle, nozzle cover and a foam sealing gasket.

A flush nozzle assembly 30 is positioned in the rear section 28 of the bowl, at a location higher than the ledge 22. The nozzle assembly contains the improved flush nozzle of the present invention. The nozzle assembly 30 is shown in greater detail in FIGS. 4–6 and includes a nozzle body 32, a nozzle cover 34 and a foam rubber gasket 36. The nozzle body 32 is a single piece molded plastic body and forms a nozzle tube 38 for bringing flush water into the toilet bowl and a lower tube 40. Tube 40 can be used as an overflow for removing water from the bowl in the event the bottom discharge outlet is blocked and water accumulates in the bowl. Alternatively, tube 40 can be used as a vent for the bowl. The nozzle body further includes an outer flange 42 extending radially outward from the nozzle and lower tubes. The nozzle body also includes a smaller inner flange 44 which extends outwardly from the sides of the nozzle and lower tubes. The rear section 28 of the bowl is formed with an aperture 46 through which the nozzle tube 38 and the lower tube 40 extend. The inner flange 44 is small enough in size to fit through the aperture 46 as well.

An oval shaped foam rubber gasket 36 is placed between the larger outer flange 42 and a smaller retaining flange 45 on the nozzle and lower tubes. The nozzle body is assembled to the bowl by inserting the end of the nozzle and lower tubes through the aperture 46 in the bowl. The gasket 36 is compressed to allow the forward ends of the nozzle and lower tubes to extend further through the aperture 46. The cover 34 is fitted over the front of the tubes and is retained by the inner flange 44 of the nozzle body. When the nozzle body 32 is released, the foam gasket 36 will partially relax, pulling the nozzle body rearward and drawing or biasing the cover 34 tight against the inner surface of the bowl. The gasket forms a water tight seal around the bowl aperture 46.

The nozzle cover includes a generally circular disc 48 which is disposed in front of the nozzle and lower tubes. The cover includes a connecting portion 50 which extends rearwardly from an upper peripheral portion of the disc 48 and connects the disc 48 to a generally inverted U-shaped yoke 52. The yoke 52 fits over the top and sides of the nozzle tube.

The yoke 52 has a small radially inwardly extending mounting flange 54 which fits immediately rearward of the inner flange 44 of the nozzle body and is interlocked therewith to prevent the cover 34 from moving forward off the nozzle body. The yoke 52 fits between the inner flange 44 and the retaining flange 45.

Near the lower ends 56 of the yoke 52, the yoke is formed with inwardly extending barbs 58. The barbs 58 snap fit over tabs 60 extending from each side of the lower tube 40. The snap fit engagement of the barbs 58 and the tabs 60 retains the cover vertically upon the nozzle body. In addition, once the foam gasket 36 has been partially relaxed, the yoke 52 is drawn into the aperture 46 in the bowl, further preventing vertical movement of the cover.

The lower tube 40 is disposed immediately below the nozzle tube 38 and includes an open end 64 located inside the toilet bowl. In the event the bottom discharge outlet is blocked, liquid accumulating in the bowl will drain through the passageway in the lower tube and out of the tube lower end 66 which can be coupled to a hose for directing the overflow to the appropriate location.

The nozzle tube 38 has an outer end 68 which is connected to a water supply hose 70. The hose 70 receives water from a vacuum breaker 72 which in turn receives water through an inlet hose 74. The tube 38 has a pair of annular barbs 76 over which the hose 70 is fitted to retain the hose on the nozzle tube 38.

At the inner end of the nozzle tube 38, the tube is closed with an end wall 80. The end wall 80 has an upper portion 82 which is generally inclined toward the upstream direction of the tube 38. The inclined upper portion 82 of the end wall initiates the downward flow-direction of the water prior to the water reaching the slot 88. The lower portion 84 of the end wall is normal to the tube. An orifice 86 is formed in the nozzle tube 38 at its end through which water is discharged into the bowl for cleaning the bowl surface. The orifice 86 includes an arcuate slot 88 in a lower peripheral portion of the tube 38, adjacent to the end wall. Water is discharged through the slot 88 directly downward onto the rear section of the bowl.

On opposite sides of the tube 38, apertures 90 are formed. The apertures 90 allow for water to flow laterally from both sides of the nozzle, in opposite directions. The water is discharged laterally onto the ledge 22 and flows circumferentially around the bowl in opposite directions over the bowl side sections 31. The water will fall downwardly off the ledge, and flow over the lower portion 26 of the bowl, rinsing the bowl surface. The oppositely directed water paths eventually meet one another at the front of the bowl. In the preferred embodiment, shown in FIG. 4, the apertures 90 are located with their upper edges located at the center line of the tube 38. As a result, flush water is directed horizontally and downwardly. The slot 88 and apertures 90 are preferably joined together to form one orifice in the nozzle. This insures that there are no gaps in the coverage of water over the bowl surface.

Figure 3:
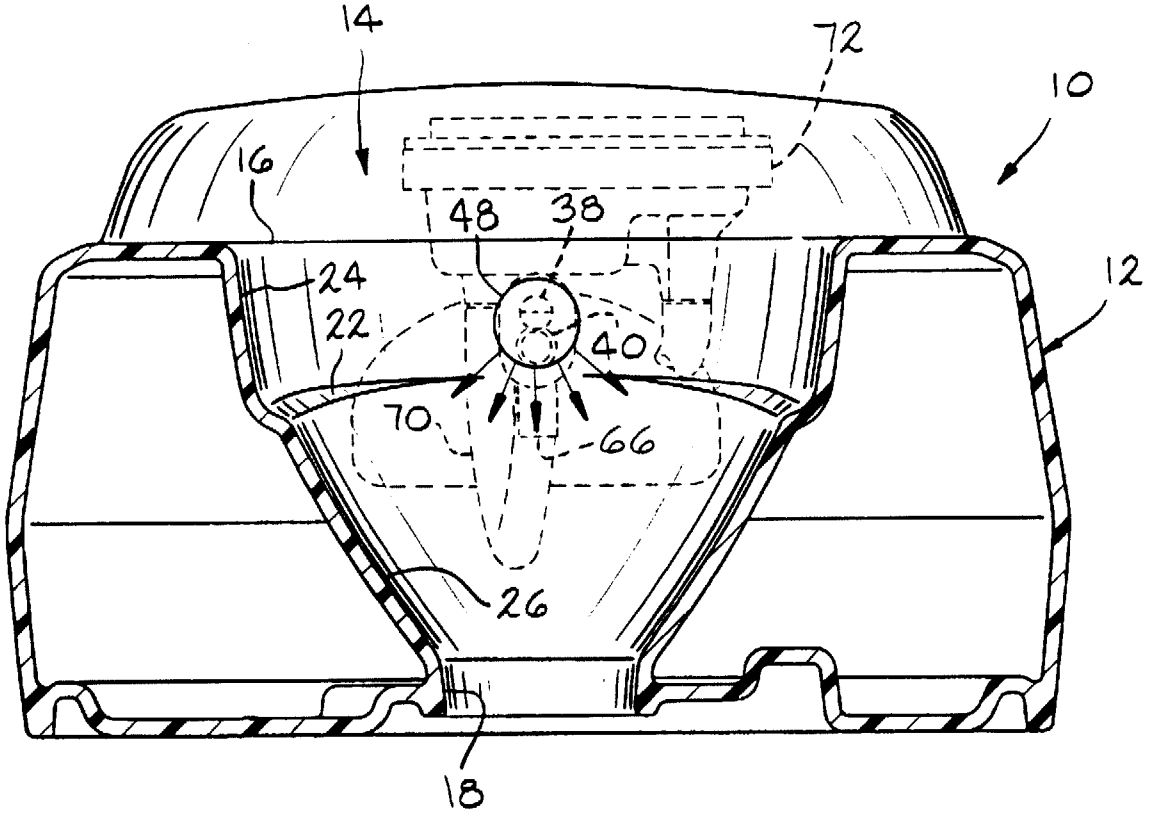
FIG. 3 is a sectional view of the bowl as seen from substantially the line 3—3 of FIG. 2 illustrating the water discharge from the nozzle.

The slot 88 extends about the lower peripheral portion of the nozzle tube over an arc sufficient to spray water downward over the rear section of the bowl. The downward spray is shown by the arrows in FIG. 3. While the angular extent of the slot can vary depending on the particular toilet and nozzle location, development testing has shown that a slot extending over an arc of 80°–100° provides the desired coverage. Testing has further found that an aperture area of five to seven times the slot area will produce the desired water velocities and volume distribution to clean the bowl. The smaller cross-sectional area of the slot results in a lower volume of water being discharged from the slot as compared to the volume discharged from the apertures. The velocity of the downwardly directed water will be greater than the velocity of the laterally directed water. The higher velocity water provides improved scrubbing of the bowl rear section.

The apertures 90 must be sized to provide sufficient water volume and velocity to completely wet the sides of the bowl with the two water streams meeting one another at the front of the bowl. The specific dimensions of the slot and dimensions and shape of the apertures will depend upon the size and shape of the bowl, the amount of flush water being used and the pressure at which the water is being pumped.

The flush nozzle of the present invention provides for improved flush performance using a single flush nozzle. The nozzle provides high velocity water flow over the rear section of the bowl to scrub the rear of the bowl while also providing lower velocity water which flows over the side surfaces and the front portion of the bowl to rinse the bowl. By using a single nozzle orifice, complete wetting of the bowl surface can be insured.

It is to be understood that the invention is not limited to the exact construction illustrated and described above, but that various changes and modifications may be made without departing from the spirit and scope of the invention as defined in the following claims.

We claim:

1. A toilet comprising:

a bowl having an open upper end and a bottom discharge outlet through which waste is removed from said bowl, said bowl having a bowl surface which extends downwardly and inwardly from said open upper end to said bottom discharge outlet, said bowl further having a rear section, a from section and arcuate side sections extending between said front and rear sections;

a flush water nozzle in said rear section of said bowl, said nozzle having orifice means for discharging water into said bowl said orifice means being a single orifice shaped to discharge water laterally in opposite directions to flow circumferentially around said bowl in two downwardly spiral paths and to discharge water downwardly in all directions between said lateral flow thereby accomplishing a substantially total wetting of said bowl for cleaning purposes; and wherein said nozzle includes a nozzle tube extending through an aperture in said bowl and terminating in an end wall in said bowl, an outer flange extending radially outward from said nozzle tube and being larger than said aperture whereby said outer flange cannot pass through said aperture; and said nozzle further comprising a cover mounted to said nozzle tube within said bowl including means for mounting said cover on said nozzle tube, said cover being larger than said aperture in said bowl whereby when said cover is placed on said nozzle tube, said nozzle tube is retained in said bowl by said cover and said outer flange.

2. The toilet of claim 1 further comprising biasing means between said outer flange and said bowl for biasing said cover against said bowl surface.

3. The toilet of claim 2 wherein said biasing means comprises a foam rubber gasket disposed outside of said bowl between said bowl and said outer flange.

4. The toilet of claim 1 wherein said cover includes a disc overlaying said end of said nozzle tube in front thereof, a connecting portion extending rearward from an upper peripheral portion of said disc and an inverted U-shaped yoke spaced rearward from said disc for placement over said nozzle tube.

5. The toilet of claim 4 where said means for mounting said cover on said nozzle tube provides snap fit interlocking of said cover onto said nozzle tube to retain said cover thereon.

* * * * *